US010119733B1

(12) United States Patent
Ilercil

(10) Patent No.: US 10,119,733 B1
(45) Date of Patent: Nov. 6, 2018

(54) THERMOELECTRIC HEAT PUMP ASSEMBLY WITH REMOVABLE BATTERY

(71) Applicant: AMBASSADOR ASSET MANAGEMENT LIMITED PARTNERSHIP, Mesa, AZ (US)

(72) Inventor: Alp Ilercil, Scottsdale, AZ (US)

(73) Assignee: Ambassador Asset Management Limited Partnership, Mesa, AZ (US)

( * ) Notice: Subject to any disclaimer, the term of this patent is extended or adjusted under 35 U.S.C. 154(b) by 0 days.

(21) Appl. No.: 15/876,930

(22) Filed: Jan. 22, 2018

Related U.S. Application Data

(63) Continuation of application No. 14/819,318, filed on Aug. 5, 2015, now Pat. No. 9,874,377.

(60) Provisional application No. 62/033,577, filed on Aug. 5, 2014.

(51) Int. Cl.
*F25B 21/02* (2006.01)
*F25B 21/04* (2006.01)

(52) U.S. Cl.
CPC ..... *F25B 21/04* (2013.01)

(58) Field of Classification Search
None
See application file for complete search history.

(56) References Cited

U.S. PATENT DOCUMENTS 5,892,656 A * 4/1999 Bass ..... H01L 35/00 136/203
6,354,104 B1 * 3/2002 Feagin ..... A61B 10/0096 220/210
2014/0318153 A1 * 10/2014 Ilercil ..... F25B 21/04 62/3.3
2015/0021989 A1 * 1/2015 Lin ..... H02J 9/06 307/23
2015/0159924 A1 * 6/2015 Calderon ..... F25D 11/006 62/3.6
2015/0305979 A1 * 10/2015 Tintinger ..... A61J 1/165 62/3.62

* cited by examiner

*Primary Examiner* — Elizabeth Martin
(74) *Attorney, Agent, or Firm* — Rodney J. Fuller; Booth Udall Fuller, PLC

(57) ABSTRACT

An active temperature controlled container is configured to be portable so as to safely transport temperature sensitive and perishable goods (such as biological material): within a vessel that is thermally coupled to a thermoelectric assembly disposed within the container, where the thermoelectric assembly is powered by a battery. The battery is secured within a compartment in an outer portion of the housing of the container in a way that the battery may be removed to be recharged, inspected, swapped out for another battery or power source, or the like.

20 Claims, 8 Drawing Sheets

40 x 40 mm, 127 couples each, 4 Layers of Thermoelectric modules Thermaly and Electrically in Series Consuming 1 Watt of Power

| Layer | Cold side | Hot side | Delta T | Voltage ( V ) | Current ( I ) | Qc | COP | I / Imax | Dt / Dtmax |
|---|---|---|---|---|---|---|---|---|---|
| (Canister ) Layer1 Temperatures | 1.4 | 7.7 | 6.3 | 1.1210 | 0.228 | 1.11 | 4.79 | 0.0648 | 0.0957 |
| Layer 2 Temperatures | 7.7 | 13.6 | 5.9 | 1.1235 | 0.228 | 1.29 | 5.65 | 0.0648 | 0.0896 |
| Layer 3 Temperatures | 13.6 | 19.1 | 5.5 | 1.1269 | 0.228 | 1.47 | 6.48 | 0.0648 | 0.0835 |
| ( Heat Sink ) Layer 4 Temperatures | 19.1 | 23.5 | 4.4 | 1.1198 | 0.228 | 1.94 | 8.24 | 0.0648 | 0.0668 |
| **Heat Pump Overall Output** | | | **22.1** | **4.4912** | **0.228** | **1.11** | **1.08** | **0.0648** | |

| Heat Pump Specifications | |
|---|---|
| Layers | 4 |
| Electrical configuration | 4 in Series |
| Total Supplied voltage ( Volt ) | 4.5 |
| Total Measured Current ( Amp ) | 0.228 |
| Total Supplied Power ( W ) | 1.026 |

| Thermoelectric Module Specifications | |
|---|---|
| Size ( mm ) | 40 x 40 |
| Number of Couples | 127 |
| Power ( Q max ) Delta T =0 ( Watts ) | 26.88 |
| Delta T Max @ Qc =0 ( Celcius ) | 65.83 |
| V max ( Volts ) | 15.3 |
| I max ( Amperes ) | 3.52 |

FIG. 6

40 x 40 mm, 127 couples each, 4 Layers of Thermoelectric modules Thermaly and Electrically in Series Consuming 3 Watts of Power

| Layer | Cold side | Hot side | Delta T | Voltage ( V ) | Current ( I ) | Qc | COP | I / Imax | Dt / Dtmax |
|---|---|---|---|---|---|---|---|---|---|
| (Canister ) Layer1 Temperatures | -7.3 | 3.1 | 10.4 | 1.8894 | 0.402 | 1.77 | 2.59 | 0.1142 | 0.1580 |
| Layer 2 Temperatures | 3.1 | 12.5 | 9.4 | 1.9038 | 0.402 | 2.30 | 3.36 | 0.1142 | 0.1428 |
| Layer 3 Temperatures | 12.5 | 20.1 | 7.6 | 1.9016 | 0.402 | 3.08 | 4.45 | 0.1142 | 0.1154 |
| ( Heat Sink ) Layer 4 Temperatures | 20.1 | 25.4 | 5.3 | 1.8637 | 0.402 | 3.93 | 5.71 | 0.1142 | 0.0805 |
| **Heat Pump Overall Output** | | | **32.7** | **7.5585** | **0.402** | **1.77** | **0.58** | **0.1142** | |

| Heat Pump Specifications | |
|---|---|
| Layers | 4 |
| Electrical configuration | 4 in Series |
| Total Supplied voltage ( Volt ) | 7.58 |
| Total Measured Current ( Amp ) | 0.402 |
| Total Supplied Power ( W ) | 3.05 |

| Thermolectric Module Specifications | |
|---|---|
| Size ( mm ) | 40 x 40 |
| Number of Couples | 127 |
| Power ( Q max ) Delta T =0 ( Watts ) | 26.88 |
| Delta T Max @ Qc =0 ( Celcius ) | 65.83 |
| V max ( Volts ) | 15.3 |
| I max ( Amperes ) | 3.52 |

FIG. 7

40 x 40 mm, 127 couples each, 4 Layers of Thermoelectric modules Thermaly and Electrically in Series Consuming 5 Watts of Power

| Layer | Cold side | Hot side | Delta T | Voltage ( V ) | Current ( I ) | Qc | COP | I / Imax | Dt / Dtmax |
|---|---|---|---|---|---|---|---|---|---|
| (Canister ) Layer1 Temperatures | -12.6 | 0.7 | 13.3 | 2.3999 | 0.526 | 2.10 | 1.84 | 0.1494 | 0.2020 |
| Layer 2 Temperatures | 0.7 | 12.1 | 11.4 | 2.4248 | 0.526 | 3.00 | 2.68 | 0.1494 | 0.1732 |
| Layer 3 Temperatures | 12.1 | 20.4 | 8.3 | 2.4097 | 0.526 | 4.32 | 3.78 | 0.1494 | 0.1261 |
| ( Heat Sink ) Layer 4 Temperatures | 20.4 | 25.1 | 4.7 | 2.3260 | 0.526 | 5.59 | 4.98 | 0.1494 | 0.0714 |
| **Heat Pump Overall Output** | | | 37.7 | 9.5604 | 0.526 | 2.10 | 0.42 | 0.1494 | |

| Heat Pump Specifications | |
|---|---|
| Layers | 4 |
| Electrical configuration | 4 in Series |
| Total Supplied voltage ( Volt ) | 9.59 |
| Total Measured Current ( Amp ) | 0.526 |
| Total Supplied Power ( W ) | 5.04 |

| Thermolectric Module Specifications | |
|---|---|
| Size ( mm ) | 40 x 40 |
| Number of Couples | 127 |
| Power ( Q max ) Delta T =0 ( Watts ) | 26.88 |
| Delta T Max @ Qc =0 ( Celcius ) | 65.83 |
| V max ( Volts ) | 15.3 |
| I max ( Amperes ) | 3.52 |

FIG. 8

THERMOELECTRIC HEAT PUMP ASSEMBLY WITH REMOVABLE BATTERY

RELATED APPLICATIONS

This application is a continuation of U.S. patent application Ser. No. 14/819,318, filed Aug. 5, 2015, which claims the benefit of U.S. provisional patent application 62/033,577, filed Aug. 5, 2014, the contents of each of which are hereby incorporated by reference in their entireties.

TECHNICAL FIELD

The present disclosure relates to active temperature controlled containers for shipping and transport of temperature sensitive goods. The active temperature controlled containers disclosed herein can be employed wherever a conventional active temperature controlled container is used with additional benefits as described herein.

BACKGROUND

Active temperature controlled containers can comprise a number of thermocouples to actively apply the Peltier effect to advantageously transport heat within an iso-thermal transport system. The Peltier effect is the presence of heating or cooling at an electrified junction of two different conductors. The Peltier effect has been advantageously used in harnessing thermoelectric effects whereby temperature differences are directly converted to electric voltages, and vice versa. Accordingly, a thermoelectric heat pump is built to include a plurality of thermocouples that include a junction of two different conductors that are electrified at the junction to create heating or cooling, according to the temperature sensitive cargo disposed within the iso-thermal transport and storage system. Examples of temperature sensitive cargo that can benefit from transport in iso-thermoelectric heat pump and storage systems include biological materials and samples, including cell and tissue cultures, nucleic acids, bodily fluids, tissues, organs, embryos, plant tissues, and other sensitive goods such as pharmaceuticals, vaccines and chemicals. Various systems for temperature regulation for transported materials requiring a stable thermal environment are known. Iso-thermal transport systems seek to be robust, efficient, and self-sufficient for safely storing and maintaining cargo during transport, storage, or both.

Conventional active temperature controlled containers tend to be heavy, bulky, and short operability times. These limitations greatly limit the utility of conventional active temperature controlled containers—especially in light of airline safety restrictions regarding certain types of rechargeable batteries.

SUMMARY

A need exists for battery powered portable transportable active temperature controlled containers and methods for providing the same. Accordingly, in an aspect, a portable transportable active temperature controlled container can comprise a housing, a vessel for holding temperature sensitive goods disposed within the housing, a thermoelectric assembly disposed within the housing and coupled to the vessel, and a compartment in an outer portion of the housing, wherein the compartment is configured to receive a removable rechargeable battery that can be disposed at least partially within the housing.

The portable transportable active temperature controlled container and the thermoelectric assembly can further comprise at least two thermoelectric unit layers being configured so that each individual thermoelectric unit layer has a ratio of input current to maximum available current (I/Imax) of 0.75 or less at a steady-state when heat removal (Q) is about 0 Watts. In certain aspects, the thermoelectric assembly is capable of maintaining a change in temperature (ΔT) of about 20° C. between the vessel and a heat sink when coupled to a battery having an output voltage less than about 8 volts and a capacity of less than about 110 watt-hours.

In another aspect, a portable transportable active temperature controlled container can comprise a thermoelectric assembly capable of maintaining a change in temperature (ΔT) of about 20° C. between the vessel and a heat sink for at least about: 60 hours when the battery has a capacity of less than about 110 watt-hours; 40 hours when the battery has a capacity of less than about 65 watt-hours; or 30 hours when the battery has a capacity of less than about 45 watt-hours.

The portable transportable active temperature controlled container can further comprise a battery disposed within the compartment. In certain aspects, the battery comprises a USB port configured to supply a voltage of about 5 volts and a current in a range of 0.5-6.0 amps.

In another aspect, the portable transportable active temperature controlled container can further comprise an overall volume of the container is less than about 1.2 cubic feet. In certain aspects, the dimensional weight of the container is substantially equal to an actual weight of the container, the dimensional weight being calculated using: a divisor between 130 and 200 for dimensions in inches; or a divisor between 3500 and 6500 for dimensions in centimeters.

In some aspects, a portable transportable active temperature controlled container can comprise a housing, a vessel for holding temperature sensitive goods disposed within the housing, a thermoelectric assembly disposed within the housing and coupled to the vessel, a rechargeable battery with a capacity of less than about 110 watt-hours, and a compartment in an outer portion of the housing, wherein the compartment is configured to removably receive the battery such that the battery is disposed at least partially within the housing.

The portable transportable active temperature controlled container can further comprise a power cord comprising a first end portion electrically coupled to the thermoelectric assembly, and a second end portion opposite the first end portion that extends outside the housing and is configured to be removably and electrically coupled to the battery. In certain aspects, the second end portion of the power cord is removably coupled to the battery.

In another aspect, the battery of the portable transportable active temperature controlled container can comprise a power supply, a charge controller, a discharge limit controller, and at least one of a boost regulator or a step down regulator. In certain aspects, the battery comprises a USB port capable of providing an output voltage of less than about 8 volts The portable transportable active temperature controlled container is configured so that an overall height of the container is less than about 14 inches and an overall volume of the container is less than about 2.2 cubic feet.

In some aspects, a portable transportable active temperature controlled container can comprise a housing having an overall volume of less than about 2.2 cubic feet, a vessel for holding temperature sensitive goods disposed within the housing, a thermoelectric assembly disposed within the housing and coupled to the vessel, the thermoelectric assembly comprising a thermoelectric unit layer being configured to have a ratio of input current to maximum available current (I/Imax) of 0.75 or less at a steady-state when heat removal (Q) is about 0 Watts, and a compartment in an outer portion of the housing, wherein the compartment is configured to receive a removable rechargeable battery having an output voltage less than about 8 volts and a capacity of less than about 170 watt-hours.

In another aspect, the portable transportable active temperature controlled container can further comprise a battery disposed within the compartment, wherein the battery can be charged with a power supply while the battery is disposed either inside or outside the container. In certain aspects, the battery further comprises a port configured to supply a voltage in a range of 3-30 volts.

The portable transportable active temperature controlled container in certain embodiments is advantageously configured so that an overall height of the container is less than or equal to 24 inches. In certain aspects, the portable transportable active temperature controlled container is configured so that an overall height of the container is less than or equal to 9.5 inches.

In another aspect, a portable transportable active temperature controlled container can comprise a thermoelectric assembly capable of maintaining a change in temperature ($\Delta T$) of about 20° C. between the vessel and a heat sink for at least about: 80 hours when the battery has a capacity of about 100 watt-hours; 50 hours when the battery has a capacity of about 60 watt-hours; or 25 hours when the battery has a capacity of about 30 watt-hours.

BRIEF DESCRIPTION OF THE DRAWINGS

FIGS. 6-8 show charts, each of which illustrates how various embodiments maximize efficiency of operation compared to previously available thermoelectric heat pump systems; the charts further illustrate how various embodiments can be configured to maximize heat pumped per unit of input power during overall use, while minimizing the ration of input current to maximum available current at a given steady-state temperature.

DETAILED DESCRIPTION

Figure 1:
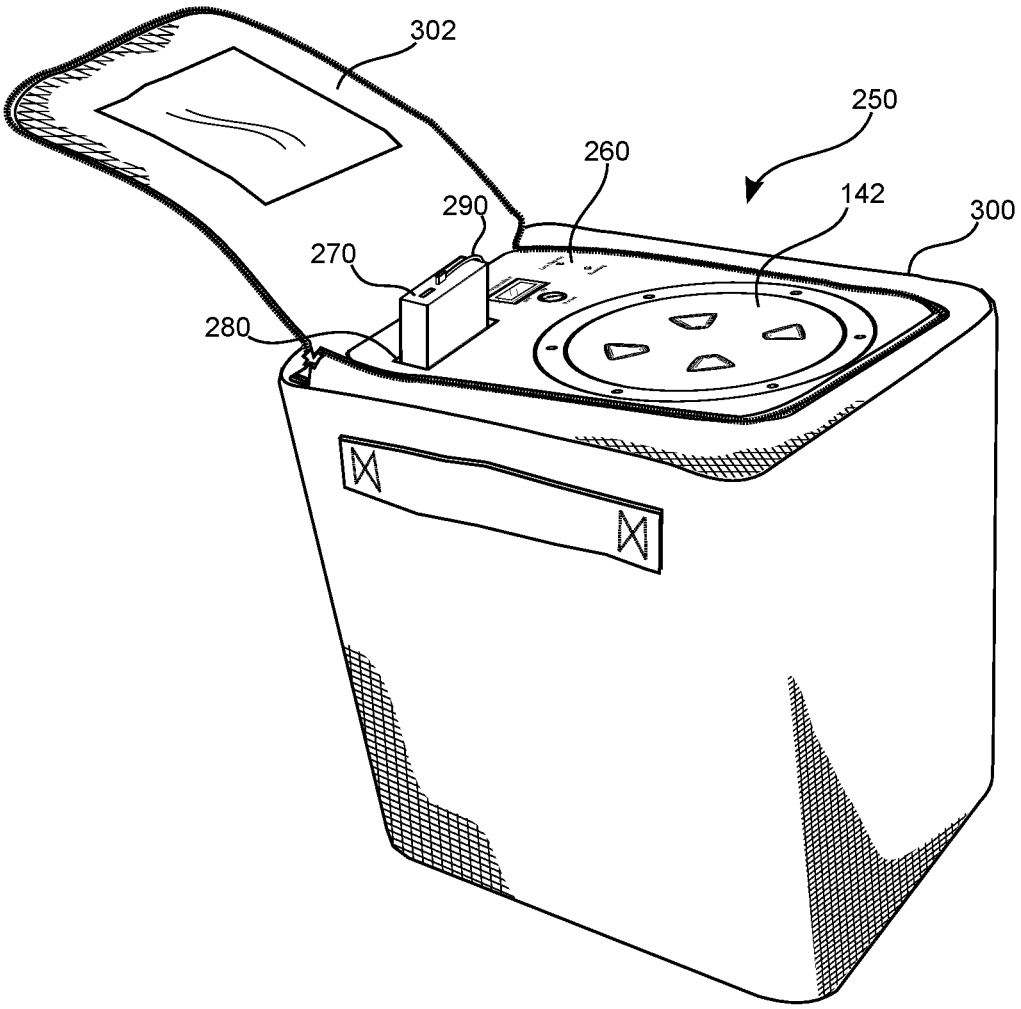
FIG. 1 shows a perspective view of the active temperature controlled container.

This disclosure, its aspects and implementations, are not limited to the specific material types, components, methods, or other examples disclosed herein. Many additional material types, components, methods, and procedures known in the art are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The words "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes embodiments of many different forms, there is shown in the drawings and will herein be described in detail particular embodiments with the understanding that the present disclosure is to be considered as an exemplification of the principles of the disclosed methods and systems, and is not intended to limit the broad aspect of the disclosed concepts to the embodiments illustrated.

FIG. 1 is a perspective view of a portable active temperature controlled container 250, which for convenience, can be referred to throughout the disclosure simply as the container 250.

The container 250 shown in FIG. 1 and described throughout the disclosure is portable in the sense that the container 250 is self-contained and can be conveniently and easily moved among locations while performing the function maintaining desirable temperatures within a portion of the container 250, such as a vessel or canister 121 configured to receive and hold temperature sensitive and perishable goods 139 including biological matter (see FIGS. 2-3), as referenced above. The portability of the container 250 can also refer to designs and configurations of the container 250 that allow the container 250 to be shippable, transportable, or both.

The term "shippable" as used herein, refers to an object, such as the container 250, that is conveyed as cargo in a hold of a vehicle such as a boat, ship, airplane, truck, or other suitable vehicle. To be shippable, the container 250 can be configured and designed to accommodate national shipping standards, international shipping standards, or both, and comply with parameters, requirements, and restrictions of the standards for movement of the container 250 during shipping. In a preferred embodiment, the assembly is completely self-contained, having its own power source and does not require recharging or an external power source during shipping in order to maintain the desired temperature parameters for the sensitive goods being shipped.

The term "transportable" as used herein, is a term that refers to an object, such as the container 250, that is conveyed not typically as cargo in a commercial shipping sense, but can be moved or transported with a passenger in a vehicle such as a boat or ship, in an airplane as carry-on luggage, in a truck, van, or personal vehicle, including in a cab or passenger compartment with a driver. Thus, an object may be transportable because of its size, convenience, weight, and self contained nature without being shippable because it does not meet applicable shipping regulations. Thus, a transportable container 250 might be transportable without being shippable because of a failure to meet some shipping requirement. Alternatively, a container 250 can be both transportable and shippable when it satisfies the relevant shipping requirements.

As shown in FIG. 1, the container 250 comprises a housing 260 that forms an exterior of the container 250. The housing 260 can be made of metal, plastic, foam, ceramics, fibers such as fiberglass or carbon fiber, glass, vacuum panels, or other suitable materials, and combinations of the above. The housing 260 can provide protection and environmental isolation for components of the container 250 such as a vessel 121 for holding temperature sensitive goods 139; a thermoelectric assembly 123 disposed within the housing 260 and coupled to the vessel 121; and a space, opening, or compartment 280 configured to receive a removable rechargeable battery 270.

The housing 260 can define overall dimensions of the container 250. In some embodiments, outer dimensions of the container 250 can be slightly adjusted by inclusion of an optional cover, case, or bag 300 having a lid 302. The cover 300 can be made of textiles, fabric, plastic, or other suitable material that can be sewn and fitted to the container 250 and can be disposed over the housing 260 to provide additional protection to the housing 260. Overall dimensions of the container 250 and housing 260, with or without a cover 300, can include a height that is less than or equal to about 24 inches (''), 16'', 14'', 12'' or 9.5'' so that the container 250 can fit underneath a seat of a passenger airplane as a carryon item. Additionally, by limiting an overall height of the container 250, the container 250 can be better suited for shipping and transport, and in some embodiments can also be less than or equal to a space between a bottom of a seat on an airline passenger airplane and the floor of the passenger airplane so that the container 250 can fit underneath the seat on the passenger airplane.

Figure 2:
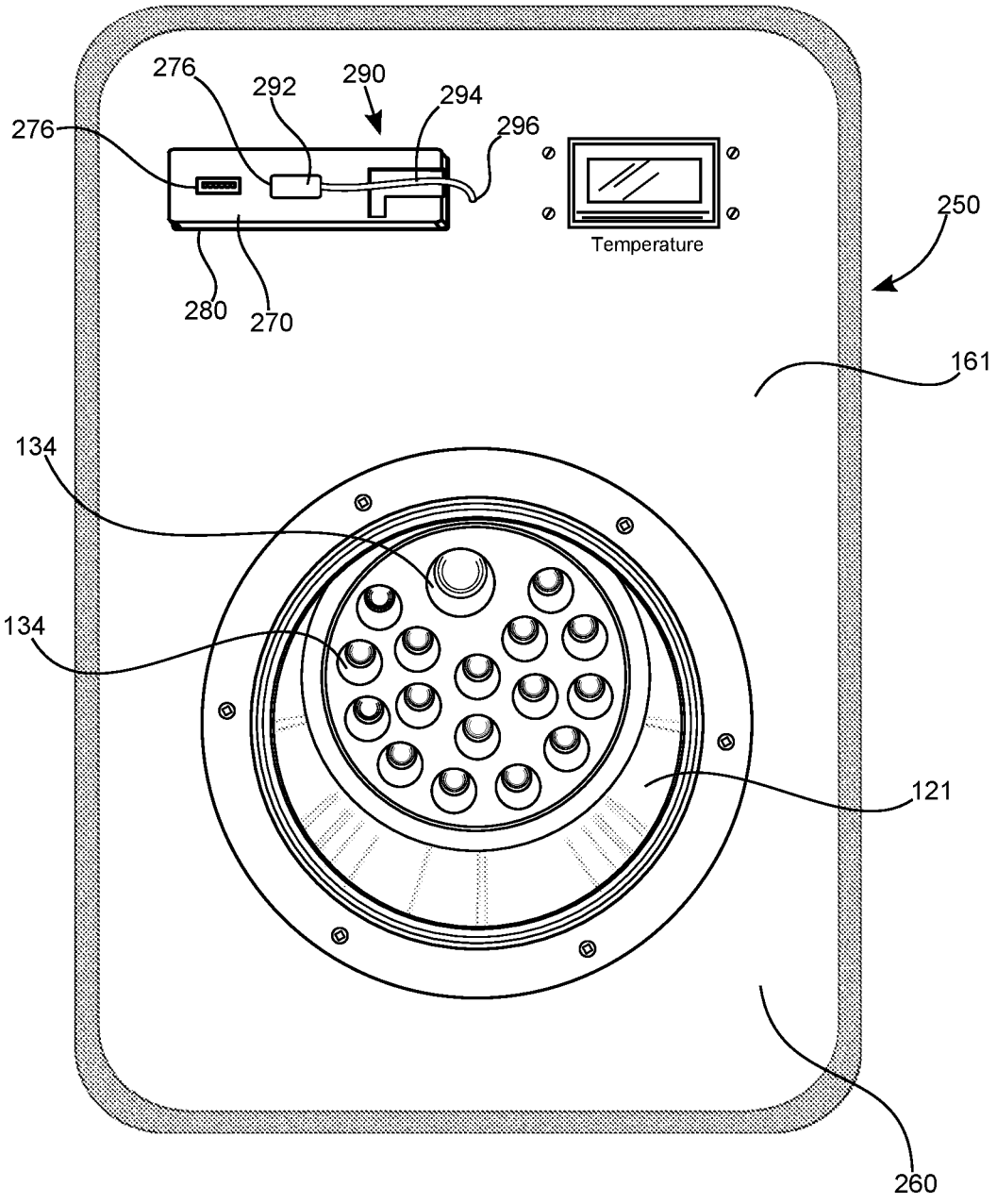
FIG. 2 shows a plan view of the active temperature controlled container shown in FIG. 1.

FIG. 2, shown below, is a top view of a container 250 having a faceplate 161 of the container 250 and a threaded cap 142 (shown in FIG. 1) used for covering, and providing access to, a vessel 121 disposed within the housing 260 that can hold, and is configured to hold, temperature sensitive goods 139 within the container 250. For example, temperature sensitive goods 139 may be placed within one or more of the openings 134 available within vessel 121. A variety of shapes and sizes for the vessel 121 and/or openings 134 may accommodate various types or quantities of temperature sensitive goods 139 in a variety of shipping environments. In some embodiments vessel 121 does not include openings 134.

Figure 3:
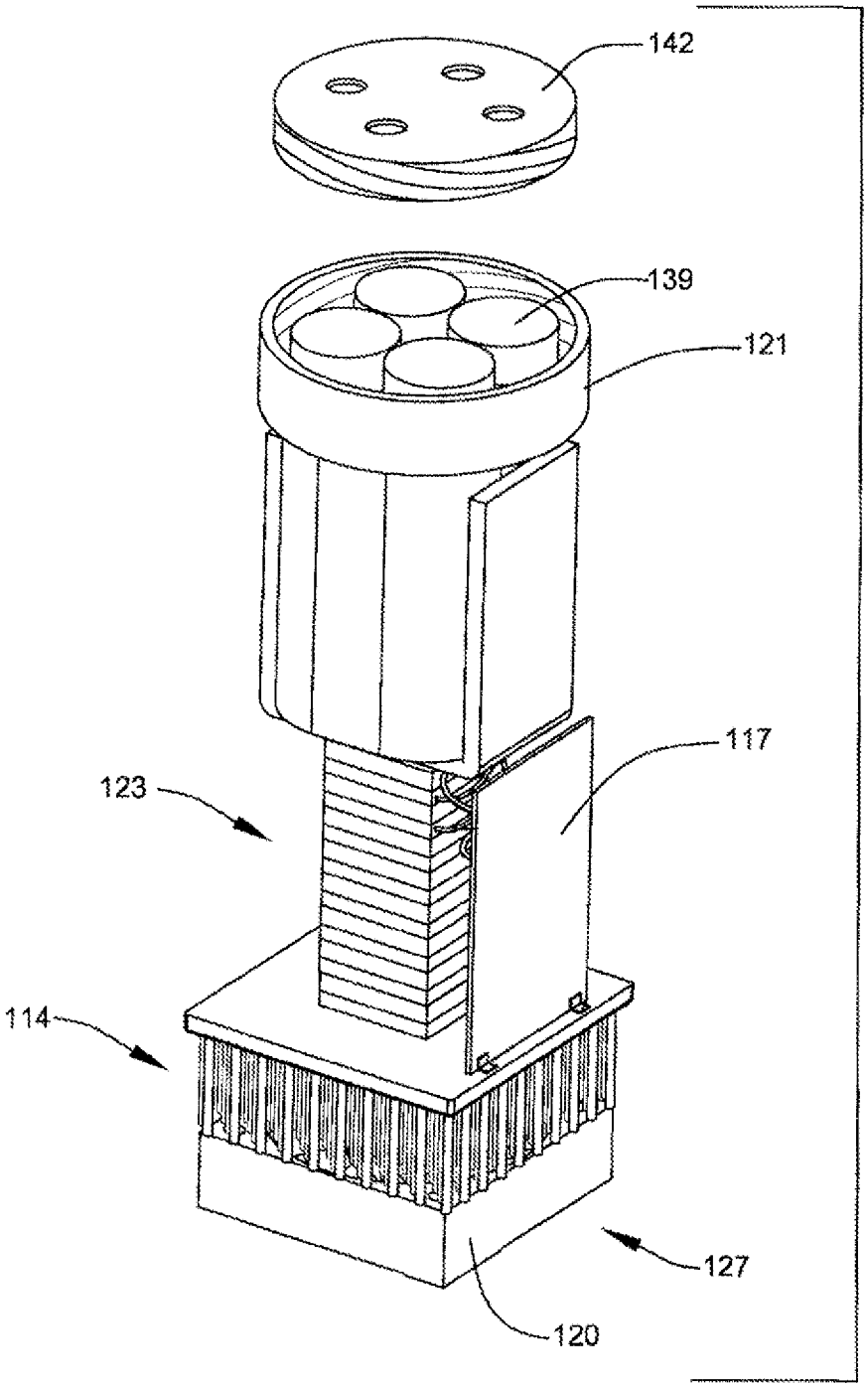
FIG. 3 shows a partially disassembled perspective view, illustrating arrangement of interior components of the active temperature controlled container shown in FIG. 1.

FIG. 3 illustrates a non-limiting example of a partially exploded perspective view of an embodiment of the container 250. More specifically, FIG. 3 shows a non-limiting example of a thermoelectric assembly 123 that can be disposed within the housing 260. As shown, thermoelectric assembly 123 can be coupled to vessel 121 into which temperature sensitive goods 139 can be disposed. In some embodiments, a heat sink 114 and/or a fan assembly 127 having a fan 120 can be coupled to the thermoelectric assembly 123. In some embodiments, thermoelectric assembly 123 may lose efficiency if not cooled. Fan 120 can circulate ambient air and thereby absorb heat from the air (in heating mode) or reject heat to the air (cooling mode). Fan assembly 127 can help transport heat from/to heat sink 114, through conductive means. Elements of fan assembly 127 and heat sink 114 can be comprised of 3000 series aluminum. Aluminum alloys have the significant advantage that they are easily and cost-effectively formed by extrusion processes. Upon reading this specification, those skilled in the art will now appreciate that, under appropriate circumstances, considering such issues as future technologies, cost, available materials, etc., other fin and heat sink materials, such as, for example, other aluminum alloys, copper, copper alloys, ceramics, cermets, etc., may suffice. Heat sink 114 can be designed for passive, non-forced air-cooling, as shown.

Figure 4:
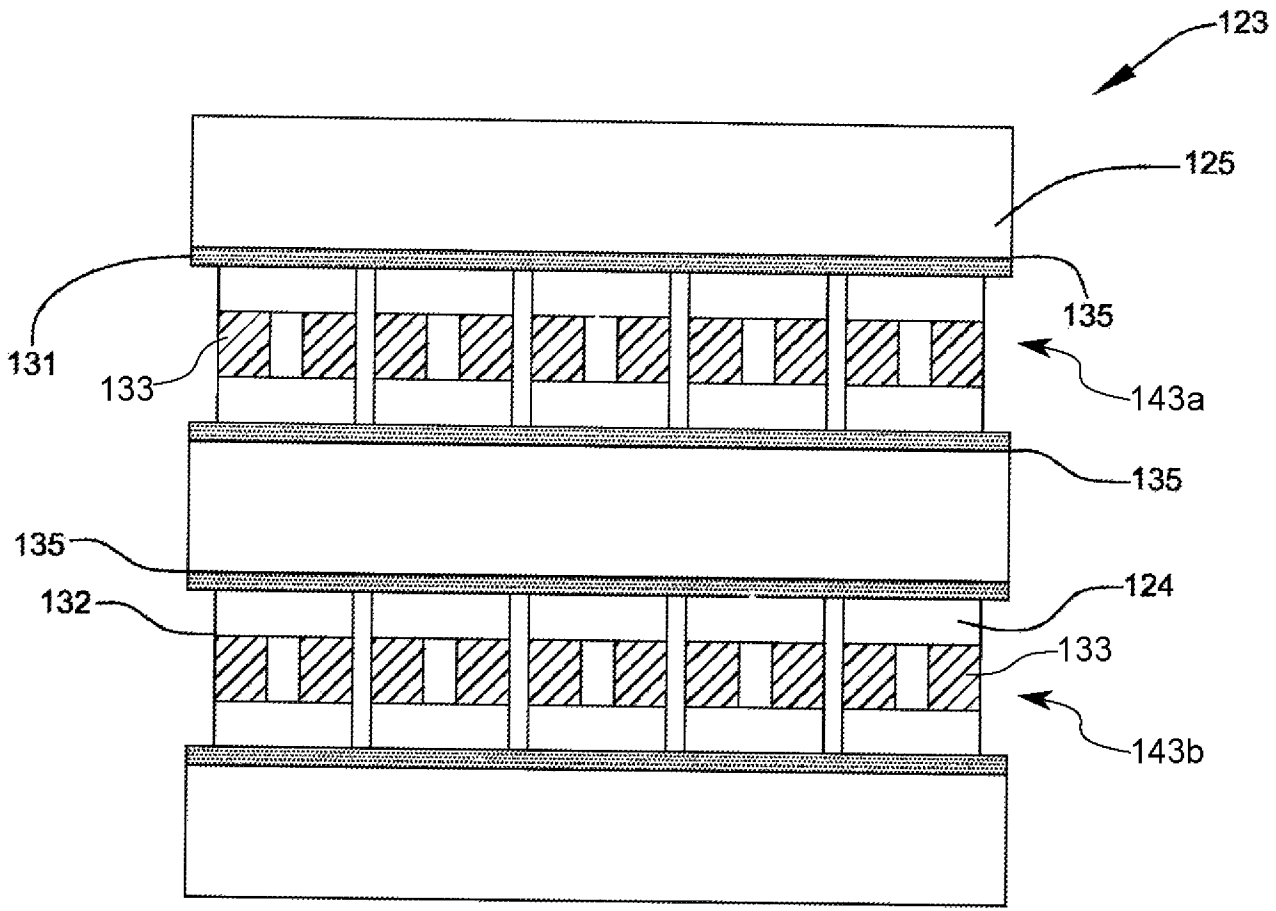
FIG. 4 shows a side profile view, illustrating a thermoelectric assembly of the active temperature controlled container.

FIG. 4 illustrates further detail of a non-limiting example of thermoelectric assembly 123 or thermal engine 123 that can be used to provide active temperature control to vessel 121 and the material stored therein. At least one thin non-electrically conductive layer 131 can electrically separate thermoelectric capacitor 125 from thermoelectric unit layers 143 while maintaining thermal conductivity. Thermoelectric unit layers 143 can comprise one or more thermoelectric semi-conductor node 133, and can additionally optionally comprise one or more thermocouples 124 as well as one or more of a thin non-electrically conductive layer 131, a silver-filled two-component epoxy 132, and a thin-film thermal epoxy 135. At least one thin-film thermal epoxy 135 can fill microscopic imperfections between thin non-electrically conductive layer 131 and thermoelectric capacitor 125. Upon reading this specification, those skilled in the art will now appreciate that, under appropriate circumstances, considering such issues as future technology, cost, application needs, etc., other thermal conductivity maximizers, such as, for example, thermal greases, thermal dopes, molecularly smoothed surfaces, etc., may suffice.

Thermoelectric unit layers 143 of thermoelectric assembly 123 can comprise a plurality of thermoelectric semi-conductor nodes 133, which are connected physically (thermally) in series, parallel, or both, and electrically in series, parallel, or both, and can use at least one power system to create at least one bidirectional heat-pump, where the power system may include a removable rechargeable battery 270, a primary cell battery, an alternating current ("AC") power system, or a combination thereof. A primary cell battery (not shown) may be one or more single-use batteries that are not rechargeable. An AC power system (not shown) may power container 250 directly from an alternating current wall outlet, such as a 110 V U.S. outlet or other outlets using for example, 115 V, 120 V, 220 V, 230 V, or 240 V. This configuration can provide progressive temperature gradients and precise temperature control (at least herein embodying wherein such control of such at least one temperature comprises controlling such at least one temperature to within a tolerance of less than about one degree centigrade or less than about one-half degree centigrade, e.g., 0.1 degree centigrade). Thermoelectric assembly 123 can be used to increase the output voltage since the voltage induced over each individual thermoelectric semi-conductor node 133 is small. Upon reading the teachings of this specification, those with ordinary skill in the art will now appreciate that, under appropriate circumstances, considering issues such as changes in technology, user requirements, etc., other heating/cooling means for example, thermoelectric refrigerators, thermoelectric generators yet to be developed, etc., may suffice.

FIG. 4 shows repetitive layers of thermoelectric unit layers 143 comprising thermoelectric semi-conductor nodes 133 and thermoelectric capacitors 125, which taken together form thermoelectric assembly 123 (also referred to as "thermal engine 123"). Thermoelectric semi-conductor node 133 can comprise bismuth-telluride that can be secured with electrically-conductive thermal adhesive, such as silver-filled two-component epoxy 132, as shown. Thin-film thermal epoxy 135 can fill any microscopic imperfections at the interface between each layer of thermoelectric capacitor 125 and thin non-electrically conductive layer 131, as shown.

In an embodiment, thermoelectric semi-conductor node 133 comprises banks of electrically parallel-connected bismuth-telluride semiconductors that are in-turn electrically connected in series and interconnected to both power supply circuits and sensing/control circuits housed on circuit board 117 coupled to thermoelectric assembly 123.

The overall efficiency of operation of thermoelectric assembly 123 can be improved with the combination of adding thermal capacitance, between each electrically series-connected (and thermally connected in series) thermoelectric semi-conductor node 133, and the ability to independently control the voltage across each series-connected thermoelectric semi-conductor node 133 (at least herein embodying wherein the thermoelectric assembly 123 comprises at least one thermal capacitor 125 adapted to provide at least one thermal capacitance in thermal association with the thermoelectric assembly 123).

Thermoelectric capacitor 125 can be the thermal capacitance added between each electrically series-connected (and thermally series-connected) thermoelectric semi-conductor node 133, as shown. Also, the voltage, across each electrically series-connected (and thermally series-connected) thermoelectric semi-conductor node 133, can be controlled by at least one closed-feedback loop sensory circuit. Further, the voltage, across each electrically series-connected (and thermally series-connected) thermoelectric semi-conductor node 133, can be independently controlled. Still further, the independently-controlled voltage impressed across each electrically series-connected (and thermally series-connected) thermoelectric semi-conductor node 133, can be integrated with adjacent such independently-controlled voltages, so as to ensure that under normal operational conditions, all electrically series-connected (and thermally series-connected) thermoelectric semi-conductor nodes 133 pump heat generally in the same direction. Additionally, any short-term variation in voltage, impressed across each electrically series-connected (and thermally series-connected) thermoelectric semi-conductor node 133, can be constrained to less than about 1% of the RMS value of the voltage impressed across each electrically series-connected (and thermally series-connected) thermoelectric semi-conductor node 133.

At least one thermoelectric capacitor 125 can be about 0.64 cm (or about 0.25 in.) thick, and can be flat with parallel polished surfaces (at least embodying herein wherein such at least one thermal capacitance is user-selected to provide intended thermal association with at least one thermoelectric assembly 123). At least one thermoelectric capacitor 125 can have slight indentations on parallel surfaces to allow the assembler to align thermoelectric capacitor 125 with thermoelectric semi-conductor node 133 while assembling thermoelectric assembly 123. Aluminum alloy 6061 can be used because of its lightweight, relatively high yield-strength of about 35000 psi, corrosion resistance, and excellent machinability. Aluminum alloy 6061 is resistant to stress corrosion cracking and maintains its strength within a temperature range of about −200 degree C. to about +165 degree C. Aluminum alloy 6061 is sold by McMaster-Carr as part number 9008K48. Alternately, thermoelectric capacitor 125 can comprise copper and copper alloys, which provide needed levels of thermal conductivity, but are not as advantageous as aluminum alloys relative to structural strength and weight considerations.

Thermoelectric capacitor 125 can be disposed between or "sandwiched" between each thermoelectric semi-conductor node 133 in thermoelectric assembly 123, as shown (at least embodying herein wherein each such sandwich layer comprises at least one set of the thermoelectric assembly 123 and at least one set of the thermal capacitors 125). Thermoelectric capacitor 125 can, during normal operation, provide delayed thermal reaction time (stores heat), and in conjunction with controlled operation of a plurality of thermoelectric semi-conductor nodes 133, may act to minimize variations in temperature swings for the temperature sensitive and perishable goods 139 (at least herein embodying wherein the intended thermal association of such at least one least one thermal capacitance is user-selected to provide increased energy efficiency of operation of the at least one thermoelectric assembly 123 as compared to the energy efficiency of operation of the at least one thermoelectric assembly 123 without addition of the at least one thermal capacitor 125).

Silver-filled two-component epoxy 132 can be a thermal adhesive (at least embodying herein wherein each such sandwich layer is thermally-conductively attached to at least one other such sandwich layer; and wherein thermal conductance between essentially all such attached sandwich layers is greater than 10 watts per meter per degree centigrade). Silver-filled two-component epoxy 132 can have a specific gravity of about 3.3, can be non-reactive and can be stable over the operating temperature range of the thermoelectric assembly 123. Silver-filled two-component epoxy 132 can be part number EG8020 from Al Technology Inc. Upon reading the teachings of this specification, those with ordinary skill in the art will now understand that, under appropriate circumstances, considering issues such as changes in technology, user requirements, etc., other materials with a high Seebeck coefficient, such as uranium dioxide, Perovskite and other such materials yet to be developed, etc., may suffice.

Metal-to-metal contact is advantageous for conducting maximum heat transfer. However, a minute amount of thin-film thermal epoxy 135 applied provides filling of any air pockets and may increase thermal conduction between thermoelectric capacitor 125 and thermoelectric semi-conductor node 133 as shown in FIG. 4. Trapped air is about 8000 times less efficient at conducting heat than aluminum; therefore, thin-film thermal epoxy 135 can be used to minimize losses in interstitial thermal conductivity, as shown. The increase in efficiency is realized because the effective contact-surface-area is maximized, thereby minimizing hot and cold spots that would normally occur on the surfaces. The uniformity increases the thermal conductivity as a direct result. Thin-film thermal epoxy 135 can be applied on both surfaces with a plastic spatula or similar device. Conductivity of thin-film thermal epoxy 135 can be poorer than the conductivity of the metals it couples; therefore it can be important to use no more than is necessary to exclude any air gaps. Upon reading the teachings of this specification, those with ordinary skill in the art will now understand that, under appropriate circumstances, considering issues such as changes in technology, user requirements, etc., other conductor enhancements, such as, for example, other thermal adhesives, material fusion, conductive fluids or other such conductor enhancers yet to be developed, etc., may suffice.

Figure 5:
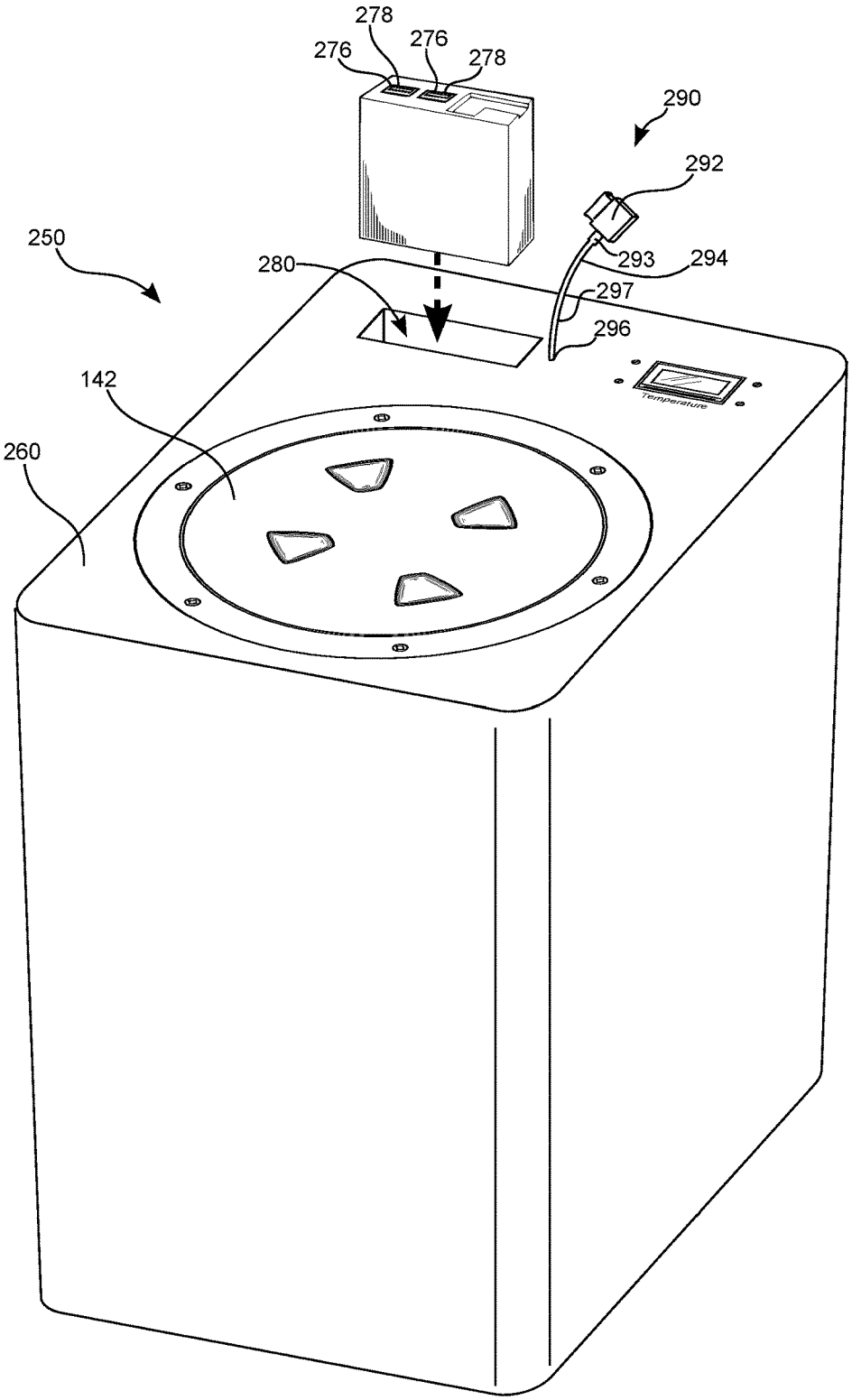
FIG. 5 shows a perspective view of the active temperature controlled container.

FIG. 5 shows a top view of the container 250 that comprises an opening or compartment 280 in an outer portion of the housing 260, wherein the compartment 280 is configured to receive a removable rechargeable battery 270.

By configuring the housing 260 with an opening or compartment 280 for a replaceable battery 270, the battery 270 for the container 250 is accessible and removable from the exterior of the housing 260 instead of having a battery that is permanently coupled or attached to the container 250, such as a battery that is disposed within the housing 260 and is not accessible from the exterior of the housing 260. The one or more battery 270 compartments 280 accessible at an exterior of the container 250 allow for a battery or batteries 270 to be replaced "on the fly" during transport or shipping of the portable container 250. Having a replaceable battery 270 that is accessible and removable from an exterior of the transport device makes inspection by security officials (such as TSA officials) easier than with permanently attached batteries and batteries disposed within the container 250 and not accessible from an exterior of the container 250. When inspecting a battery 270 to see if the battery 270 complies with safety or shipping regulations, security personnel can, for example, simply remove the battery 270 from the container 250 and read the manufacturer's battery 270 specifications printed on the battery 270 surface.

Because the battery 270 is replaceable with respect to the container 250, a power supply connector, electrical connection, or electrical interface 290 can be included as part of the container 250 to allow the battery 270 to be electrically coupled to the thermoelectric assembly 123 and other electrical components of the container 250. The power supply connector 290 may include a coupler 292 configured to couple to the battery 270, a length of insulated electrical power cord 294, and couple to container 250 at coupler 296 (container 250 and coupler 296 may fixedly couple, as shown, or removably couple). The coupler 292 can be disposed on an exposed face of the battery 270, as shown, so that when the battery 270 is disposed within the compartment 280, the coupler 292 and cord 294 of the power supply connector 290 can be exposed with respect to the container 250.

In certain non-limiting embodiments of container 250 the power supply connector 290 can be attachable/detachable by having both coupler 292 and coupler 296 as releasable couplers. The power cord 294 can be coupled to the thermoelectric assembly 123 and other electrical components of the container 250 at (releasable) coupler 296 and extend from an exterior of the container 250 outside of an exterior surface of the container 250 so that the power supply cord 294 can be releasably attached to the battery 270 at (releasable) coupler 292.

In some non-limiting embodiments of container 250 coupler 296 (located at a first end portion 297 of the power cord 294) can be permanently coupled to the container 250 and coupled to the thermoelectric assembly 123, and coupler 292 (located at a second end portion 293 of the power cord 294 opposite the first end 297) can extend outside the housing 260 and be removably coupled to the battery 270. The coupler 292 at the second end 293 can be removably coupled to the battery 270. Alternatively, a power supply connector 290 can have first end 297 and second end 293 that are removably coupled to both the battery 270 and the container 250.

In some embodiments, when at least one end 293/297 of the power supply connector 290 is configured to be removably coupled to either the container 250 and/or the removable battery 270, the power supply connector 290 (and particularly the removable end of the power supply connector 290) can be held in place by a fabric case, such as lid 302 of cover 300 (see FIG. 1), that prevents the container 250 from being accidently or inadvertently shut off or disconnected from its power source during transport or shipping of the portable container 250.

In some non-limiting embodiments of container 250 the coupler 292 can be rigidly connected within the compartment 280 of the container 250 that is configured to receive the battery 270 so that when the battery 270 is disposed within the compartment 280, the battery 270 pushes onto or into the coupler 292. Thus, power port 276 of battery 270 can be located on any of the surfaces of battery 270 and mate with coupler 292 of container 250 in various ways. For example, power port 276 may be on the bottom or lower side portions of battery 270 and mate with a coupler 292 located at the bottom or lower side portions of compartment 280 (where power cord 294 and coupler 296 may be omitted). In some embodiments coupler 296 is located at or near the bottom of compartment 280 and a retractable or non-retractable power cord 294 has sufficient length that coupler 292 can mate with power port 276 while battery 270 is out of the compartment 280. Upon reading the teachings of this specification, those with ordinary skill in the art will now understand that, under appropriate circumstances, considering issues such as changes in technology, user requirements, etc., other coupling enhancements, such as, for example, other coupling methods, coupling types, coupling locations, or other such coupling systems yet to be developed, etc., may suffice.

The removable battery 270 can be sized to comprise a size, shape, and volume substantially equal to, and slightly less than, a size, shape, and volume of the opening or compartment 280 within the container 250 that is configured to receive the battery 270. As such, the battery 270 can be friction fit within the compartment 280. Additionally, latches, clips, snaps, levers, springs, or other attachment device(s) can also be used, in addition to or instead of, friction between the battery 270 and the compartment 280 for holding the battery 270 in place and within the compartment 280.

The removable battery 270 can comprise a power port 276, such as a USB connection 278 or other connection that is configured to supply one or more voltages in a range of 3-30 volts including, for example, 5, 9, 12, 14, 18, or 19V. The battery 270 can comprise multiple power supply connections, such as ports (like power port 276) for power supply connectors 290 to plug into. In some embodiments, the power port(s) 276 of battery 270 can include one or more USB ports and additional non-USB ports such as lap-top style ports, and other ports. For example, one non-limiting example of a portable battery 270 uses a battery made by HyperJuice that can be removably included within compartment 280 of container 250.

The removable battery or batteries 270 described above can comprise one or more of: a power supply or power supply connector, a charge controller, and a discharge limit controller (not shown). The removable battery or batteries 270 can further comprise a boost regulator, a step down regulator, or both (not shown). The power supply can allow the battery 270 to be charged and can include, for example, prongs or tines that can be inserted into a standard wall socket, such as the 110 volt wall socket found in the US, or any other wall socket found in any other country. The power supply ports 276, such as USB port 278 or non-USB ports that allow the battery 270 to be electrically coupled to the container 250 and the thermoelectric assembly 123 of the container 250. The removable battery or batteries 270 described above can comprise one or more power supply ports 276, that allow the battery 270 to be charged at a conventional wall socket. In this way, a user might carry two replaceable batteries 270. A first battery 270 that is providing power for the container 250, and second back-up or replacement battery 270 that can be charged or charging while the first battery 270 is providing power for the container 250.

A charge controller can be a device or circuit that prevents the battery 270 from being overcharged and stops power or additional current from flowing into the battery 270 until a desired charge level has been reached for the battery 270. A desired level of charge can vary by battery 270, and common configurations of a lithium ion battery can be charged, e.g., to a voltage of 4.2 volts. The charge controller of the battery 270 can regulate when the charging of the battery 270 will stop to prevent overcharging or damage to the battery 270.

A discharge limit controller (also known as protection circuitry, a safety shutdown, or a PCB protections circuit) can be a device or circuit that prevents the battery 270 from being discharged to an unsafe level or voltage and stops power or additional current from flowing out of, or being withdrawn from, the battery 270 once a desired minimum level has been reached for the battery. A desired level of discharge can vary by battery 270. For example, a lithium ion battery can become a fire hazard and catch fire if discharged to a voltage of about 2.4 volts. While a microprocessor can include a discharge limit controller, the battery 270 itself can also include a discharge controller.

A boost regulator can boost or increase a naturally occurring voltage from the materials used in making the battery 270 to result in a desired voltage at a desired power output for the battery 270. For example, a boost regulator can increase the 4.2 volts of a lithium ion battery to the 5 volts used by a standard USB connection.

The boost regulator of the battery 270 can adjust an output voltage of lithium ion batteries that can naturally produce a voltage of about 3.7 volts, while USB ports/connections are standardized to operate at 5 volts. As such, a boost regulator can convert the 3.7 volts of a lithium ion battery to be 5 volts (such as for USB ports/connections) or any desired voltage (such as 12 or 15 volts like with a car battery) at battery 270 output power port 276.

Similarly, a step down regulator or dc to dc convertor can lower, step down, or decrease a naturally occurring voltage to a desired voltage at a power output of the battery. For example, a step down regulator can decrease a battery voltage from 19 volts to the 5 volts used by a standard USB connection.

Depending on the configuration and design of the portable transportable active temperature controlled container 250, and the conditions in which it operates, such as a temperature differential between the set point temperature of the container 250's vessel 121 and the ambient temperature surrounding the vessel 121, different power consumption rates can be used in maintaining the set point temperature. As such batteries 270 of different capacities might also be selected based on the need of the container 250 and particular transportation or shipping constraints. In some embodiments, the container 250's rate of power consumption will be 0.5-3.0 watts per hour with an average rate of power consumption of about 0.75 watts per hour.

As such, a battery 270 used to power the container 250 can have a capacity in a range of 10-200 watt-hours, such as a capacity of about 20 watt-hours, about 44 watt-hours, about 60 watt-hours, about 100 watt-hours, or any other number of watts desired to operate the portable transportable active temperature controlled container 250. In some embodiments the battery 270 has a capacity of no more than about 90-120 watt-hours. In some embodiments, the container 250 will provide active heating and cooling to maintain a temperature set point for periods of up to 60 hours or more of continuous use. In some embodiments, batteries 270 will be industrial grade and will provide for 500-700 discharge cycles, which can provide for about 3 years of daily use, and more years of intermittent use. The disclosed thermoelectric assembly 123 may operate at an efficiency (or "operability ratio") where the ratio of battery 270 watt-hour capacity to total operability time is approximately equal to 0.4 to 1.4. Thus, for an operability ratio of, for example, 1.0, container 250 may operate under normal conditions for up to: 100 hours on a 100 watt-hour battery 270, 60 hours on a 60 watt-hour battery 270, and so forth. In some embodiments the operability ratio is approximately 1.2, 1.0, 0.9, 0.75, 0.6, etc., when container 250 is operated under normal conditions.

Some batteries 270 will comprise a 5 volt USB port 278 that can supply a current in a range of 0.5-4.0 amps (such as 0.5, 1.0, 2.1, 2.4, 3.5, or, 4.0 amps). The batteries 270 can be exposed from an exterior of the container 250 when the battery is disposed within the compartment 280 and is disposed at least partially within the housing 260. Existing containers 250 as known in the art do not have USB connections 278 and are not able to operate on the 5V provided by USB connections, being instead configured to run, e.g., on 12V. Currently, existing containers 250 as known in the art use, for example, non-USB or laptop style battery chargers to charge 12V battery permanently disposed within the unit. To the contrary, by using removable batteries 270 with 5V USB connections 278, compatibility for recharging the batteries 270 is based on an international standard. Advantageously, compatibility issues with varying power configurations and voltages for differing national standards, such as standards for different countries wall socket outlets, are avoided or minimized. Thus, a replaceable battery 270 for the container 250 can be charged with a power supply or portable power supply, such as conventional phone charger whether the battery 270 is disposed within the compartment 280 or outside the container 250. For example, while waiting at an airport, a person transporting a container 250 can use a power supply such as a cell phone charger to charge the battery 270, or to supply power to the unit, while waiting for a flight. Thus extending the life or run-time of the battery 270 and accommodating longer travel times and delays encountered over varying circumstances across the world.

Moreover, the container 250 described herein presents a distinct advantage over competing devices because battery 270 can be readily replaced rather than forcing container 250 to sit unused during the recharge period. Thus, a shipping company will have much faster turn-around times for individual containers 250 because one container 250 can terminate one shipment and immediately start a new shipment by simply swapping out a depleted battery 270 with a charged battery 270—all without holding or delaying container 250 for hours to charge the depleted battery 270.

Additionally, a battery 270 that has reached a maximum number of discharges/recharges and is experiencing decreased performance can be easily replaced for a new battery 270 without a need of opening, rebuilding, or retrofitting the entire container 250 to replace the battery 270.

Accordingly, the container 250 described herein presents a number of advantages including a container 250 comprising a weight of as little as about 7.5 lbs. that can provide about 48-60 hours of operation on single battery charge to battery 270, whereas units previously known in the art would weight in a range of about 13-16 lbs. and operate for about 30 hours. As such, the container 250 described herein can operate for about twice the time and weigh about half as much as those units used conventionally. Furthermore, the units described herein can comprise a dimensional weight that is substantially equal to the unit's actual weight. Dimensional weight is a weight that is calculated by a shipping or transport companies that takes into account both an object's size and weight. For example, UPS and Fed Ex multiply a package height (z), length (y), and width (x) in inches to achieve a package volume, and then divide the package volume by a constant divisor to achieve a dimensional weight in pounds. Until June 2014, the accepted industry divisor was 194. Beginning June 2014, a new, smaller, divisor of 166 was adopted by the industry, increasing shipping charges by about 35%. In some embodiments the portable transportable active temperature controlled container 250 has a total weight and volume approximately equal to the dimensional weight where the dimensional weight is calculated using: a divisor between 100 and 200 for dimensions in inches (e.g., a divisor of about 194, 166, 150, 133, 120, etc.); or a divisor between 3000 and 7000 for dimensions in centimeters (e.g., a divisor of about 6500, 6000, 5500, 5000, 4700, 4000, 3500, etc.).

Advantageously, the portable transportable active temperature controlled containers 250 described herein can be built such that an actual weight is equal to a dimensional weight in order to save on shipping and transport costs. As such, the portable transportable active temperature controlled containers 250 described herein can comprise an actual weight of 18 pounds and a height in a range of 9-14", or a height less than about 12" (such as 11¾"), or a height less than about 9.5" that provide shipping savings on the order of $60 USD per shipment. In some embodiments, the container 250 can comprise lengths and widths in a range of 9-16". In some embodiments the portable transportable active temperature controlled container 250 has dimensions (e.g., L×W×H if having a box-like shape) comprising a total volume of less than about 4 cubic feet (e.g., 3.5, 3, 2.5, 2.2, 2, 1.8, 1.5. 1.2, etc., cubic feet).

Additionally, lithium ion batteries face restrictions by airlines. As of July 2014, lithium batteries must have 5 cells or less and each cell must be less than 20 watts each so that the entire battery is less than 100 watts in order for the battery to be shipped by airlines. If not, then the lithium battery must be labeled as a hazardous material. For this reason, nickel metal hydride or other unregulated battery types are used to facilitate shipping. Other active temperature controlled containers as known in the art comprise 18V, 240 watt, lithium ion batteries that are permanently formed or integrally fixed as part of the container. As such, the lithium ion batteries are not conducive to shipping and must be marked as hazardous cargo per international air shipping standards. In order to avoid these restrictions, other conventional units would use batteries made of nickel metal hydride that would need to weigh about 3.5 lbs. in order to provide about 100 W of power. By using smaller more efficient lithium ion batteries for battery 270 of container 250, 100 W of power can be provided with only about 1 lb. of weight, which is a third of the weight, which significantly reduces shipping/transport cost.

FIGS. 6-8 show charts, each of which illustrate how various embodiments maximize efficiency of operation compared to previously available thermoelectric heat pump systems. The charts further illustrate how various embodiments can be configured to maximize heat pumped per unit of input power during overall use, while minimizing the ratio of input current to maximum available current at a given steady-state temperature. FIGS. 6-8 display charts that indicate the performance of various embodiments of the active temperature controlled containers 250 including 4 series connected thermoelectrics in the thermoelectric assembly 123. FIG. 6 provides detail for a non-limiting example in which the thermoelectrics in the thermoelectric assembly 123 consume approximately 1 watt of power. FIG. 7 provides detail for a non-limiting example in which the thermoelectrics in the thermoelectric assembly 123 consume approximately 3 watt of power. FIG. 8 provides detail for a non-limiting example in which the thermoelectrics in the thermoelectric assembly 123 consume approximately 5 watts of power.

FIGS. 6-8 further emphasize advantages of container 250 or thermoelectric assembly 123 in which the maximum current, current, maximum Delta-T, Delta-T, transferred heat, voltage, ratio of current to maximum current, ratio of Delta-T to maximum Delta-T, are displayed. The maximum values indicated within FIGS. 6-8, such as $I_{max}$ and $Q_{max}$, are those values provided by a manufacturer in the specifications for a particular part or thermoelectric module. Determining a size or capacity for a particular component can based on design constraints and manufacturer specifications for particular component features or parameters such as $I_{max}$ and $Q_{max}$. Sizing components based on manufacturer recommendations can also be accomplished using automated systems and software programs such as "Aztec Thermoelectric Cooler Analysis" software, made by Laird Technologies.

In the non-limiting example of an active temperature controlled containers 250 having the performance details shown in the charts of FIGS. 6-8, the thermoelectric assembly 123 is a thermoelectric module having: four layers connected thermally and electrically in series; 127 total thermocouples; 40 mm×40 mm area of each thermocouple; a power ($Q_{max}$) at Delta T=0 of 26.88 W; a Delta T. (at Qc=0) of 65.83° C.; a maximum voltage ($V_{max}$) of 15.3 V; and a maximum current ($I_{max}$) of 3.52 A.

In some embodiments the thermoelectric assembly 123 can be configured so that each thermoelectric unit layer 143 at steady-state during operation has ratio or coefficient of performance ("COP") of the heat removed divided by the input power that is prior to and less than the peak COP on a COP curve of performance. Thus, the COP is defined as the amount of heat transferred from vessel 121 divided by the amount of power (voltage multiplied by current) required to operate the thermoelectric assembly 123. As can be seen from a comparison of FIGS. 6-8, as voltage increases for a given thermoelectric assembly 123, delta T, or a temperature difference between a cold side and a hot side of at least one thermoelectric unit layer 143, also increases and a COP decreases along a same direction of thermoelectric assembly 123. However, as seen in FIGS. 6-8, the operating point coefficient of performance for the thermoelectric assembly 123 is well above the typical operating point coefficient of performance. That is, the thermoelectric assembly 123 is able to pump more heat from vessel 121 to heat sink 114 using less current and ultimately less power than typical thermoelectric systems.

In some embodiments the thermoelectric assembly 123 is configured so that each individual thermoelectric unit layer 143 has a ratio of input current to maximum available current ($I/I_{max}$) of 0.35 at steady-state. The thermoelectric assembly 123 can also be configured so that the $I/I_{max}$ is 0.09 or less (e.g., 0.076) at a steady-state, when change in temperature (ΔT) of the thermoelectric assembly 123 at the top end compared to the bottom end of the thermoelectric assembly 123 is about 20° C. and heat removal (Q) is about 0 Watts; and/or the ratio of input current to maximum available current ($I/I_{max}$) of each individual thermoelectric unit layer 143 is 0.18 or less at a steady-state, when change in temperature (ΔT) of the thermoelectric assembly 123 at the top end compared to the bottom end of the thermoelectric assembly 123 is about 40° C. and heat (Q) is about 0 Watts. In some embodiments the thermoelectric assembly 123 is configured so that each individual thermoelectric unit layer 143 has a ratio of input current to maximum available current ($I/I_{max}$) of about 0.85 or less (e.g., 0.75, 0.60, 0.45) at steady-state.

It will be understood that the embodiments disclosed are not limited to the specific components disclosed herein, as virtually any components consistent with the intended operation of a method and/or system implementation for such an embodiment may be utilized. Accordingly, for example, although particular component examples may be disclosed, such components may be comprised of any shape, size, style, type, model, version, class, grade, measurement, concentration, material, weight, quantity, and/or the like consistent with the intended purpose, method and/or system of implementation.

In places where the description above refers to particular implementations or embodiments, it should be readily apparent that a number of modifications may be made without departing from the scope and/or spirit thereof and that these principles and modifications may be applied to other such embodiments. The presently disclosed embodiments are, therefore, to be considered in all respects as illustrative and not restrictive. Also, U.S. patent application Ser. No. 14/228,048 filed Mar. 27, 2014, entitled "Thermo-Electric Heat Pump Systems" is incorporated by reference thereto in its entirety for a more full disclosure of all aspects of the elements of the embodiments of the invention.

What is claimed is:

1. A portable transportable active temperature controlled container comprising:
- a housing, wherein a dimensional weight of the container is substantially equal to an actual weight of the container, the dimensional weight being calculated: as the volume of the container divided by a divisor, wherein the divisor is between 130 and 200 when the volume is calculated in inches; and the divisor is between 3500 and 6500 when the volume is calculated in centimeters;
- a vessel for holding temperature sensitive goods disposed within the housing;
- a thermoelectric assembly disposed within the housing and coupled to the vessel, the thermoelectric assembly comprising at least two thermoelectric unit layers, wherein the at least two thermoelectric unit layers comprise a delta T that increases for each thermoelectric unit layer in a first direction towards the vessel and an amount of heat transferred by the thermoelectric unit layer (Qc) that increases for each thermoelectric unit layer in a second direction opposite the first direction and away from the vessel, and wherein each of the at least two thermoelectric unit layers comprises multiple semiconductor nodes; and
- a compartment in an outer portion of the housing, wherein the compartment is configured to receive a removable rechargeable battery that can be disposed at least partially within the housing.

2. The portable transportable active temperature controlled container of claim 1, wherein the thermoelectric assembly is capable of maintaining a change in temperature (ΔT) of about 20° C. between the vessel and a heat sink for at least 60 hours when the rechargeable battery has a capacity up to 110 watt-hours.

3. The portable transportable active temperature controlled container of claim 1, further comprising:
- the rechargeable battery disposed within the compartment, wherein the rechargeable battery can be charged with a power supply while the rechargeable battery is disposed either inside or outside the container.

4. The portable transportable active temperature controlled container of claim 3, wherein the rechargeable battery further comprises a port configured to supply a voltage in a range of 3-30 volts.

5. The portable transportable active temperature controlled container of claim 1, wherein an overall height of the container is less than or equal to 24 inches.

6. A portable transportable active temperature controlled container comprising:
- a housing;
- a vessel for holding temperature sensitive goods disposed within the housing;
- a thermoelectric assembly disposed within the housing and coupled to the vessel, the thermoelectric assembly comprising at least two thermoelectric unit layers, wherein the at least two thermoelectric unit layers comprise a delta T that increases for each thermoelectric unit layer in a first direction towards the vessel and an amount of heat transferred by the thermoelectric unit layer (Qc) that increases for each thermoelectric unit layer in a second direction opposite the first direction and away from the vessel, and wherein each of the at least two thermoelectric unit layers comprises multiple semiconductor nodes comprising at least 127 thermocouples;
- a rechargeable battery with a capacity of less than 170 watt-hours; and
- a compartment in an outer portion of the housing, wherein the compartment is configured to removably receive the rechargeable battery such that the rechargeable battery is disposed at least partially within the housing.

7. The portable transportable active temperature controlled container of claim 6, wherein the at least two thermoelectric unit layers are configured so that each individual thermoelectric unit layer has a ratio of input current to maximum available current (I/Imax) of 0.35 or less at a steady-state when heat removal (Q) is about 0 Watts.

8. The portable transportable active temperature controlled container of claim 6, wherein the thermoelectric assembly is capable of maintaining a change in temperature (ΔT) of about 20° C. between the vessel and a heat sink when coupled to the rechargeable battery, the rechargeable battery having an output voltage up to 8 volts and a capacity up to 110 watt-hours.

9. The portable transportable active temperature controlled container of claim 6, wherein the rechargeable battery comprises a universal serial bus ("USB") port configured to supply a voltage of about 5 volts and a current in a range of 0.5-6.0 amps.

10. The portable transportable active temperature controlled container of claim 6, wherein a dimensional weight of the container is substantially equal to an actual weight of the container, the dimensional weight being calculated as the volume of the container divided by a divisor, wherein the divisor is between 130 and 200 when the volume is calculated in inches; and the divisor is between 3500 and 6500 when the volume is calculated in centimeters.

11. The portable transportable active temperature controlled container of claim 10, wherein an overall height of the container is less than or equal to 9.5 inches.

12. The portable transportable active temperature controlled container of claim 10, wherein the thermoelectric assembly is capable of maintaining a change in temperature (ΔT) of about 20° C. between the vessel and a heat sink for at least 25 hours when the rechargeable battery has a capacity up to 30 watt-hours.

13. The portable transportable active temperature controlled container of claim 12, wherein an overall volume of the container is up to 1.2 cubic feet.

14. A portable transportable active temperature controlled container comprising:

a housing having an overall volume up to 2.2 cubic feet;

a vessel for holding temperature sensitive goods disposed within the housing;

a thermoelectric assembly disposed within the housing and coupled to the vessel, the thermoelectric assembly comprising at least two thermoelectric unit layers being configured so that each individual thermoelectric unit layer has a ratio of input current to maximum available current (I/Imax) of 0.75 or less at a steady-state when heat removal (Q) is about 0 Watts, wherein the at least two thermoelectric unit layers comprise a delta T that increases for each thermoelectric unit layer in a first direction towards the vessel and an amount of heat transferred by the thermoelectric unit layer (Qc) that increases for each thermoelectric unit layer in a second direction opposite the first direction and away from the vessel, and wherein each of the at least two thermoelectric unit layers comprises multiple semiconductor nodes comprising at least 127 thermocouples; and a compartment in an outer portion of the housing, wherein the compartment is configured to receive a removable rechargeable battery having an output voltage up to 8 volts and a capacity up to 170 watt-hours.

15. The portable transportable active temperature controlled container of claim 14, further comprising the rechargeable battery disposed within the compartment.

16. The portable transportable active temperature controlled container of claim 15, wherein the rechargeable battery comprises:

a power supply;

a charge controller;

a discharge limit controller; and at least one of a boost regulator or a step down regulator.

17. The portable transportable active temperature controlled container of claim 14, wherein a dimensional weight of the container is substantially equal to an actual weight of the container, the dimensional weight being calculated: as the volume of the container divided by a divisor, wherein the divisor is between 130 and 200 when the volume is calculated in inches; and the divisor is between 3500 and 6500 when the volume is calculated in centimeters.

18. The portable transportable active temperature controlled container of claim 17, wherein the at least two thermoelectric unit layers are configured so that each individual thermoelectric unit layer has a ratio of input current to maximum available current (I/Imax) of 0.35 or less at a steady-state when heat removal (Q) is about 0 Watts.

19. The portable transportable active temperature controlled container of claim 17, wherein an overall height of the container is up to 14 inches and an overall volume of the container is up to 1.2 cubic feet.

20. The portable transportable active temperature controlled container of claim 17, further comprising a power cord comprising:

a first end portion electrically coupled to the thermoelectric assembly; and a second end portion opposite the first end portion that extends outside the housing and is configured to be removably and electrically coupled to the rechargeable battery.

* * * * *